United States Patent [19]

Brix et al.

[11] 4,434,739

[45] Mar. 6, 1984

[54] FIN RUDDER FOR SHIPS

[75] Inventors: Joachim Brix, Hamburg; Friedrich Weiss, Ahrensburg, both of Fed. Rep. of Germany

[73] Assignee: Jastram-Werke GmbH KG., Hamburg, Fed. Rep. of Germany

[21] Appl. No.: 363,489

[22] Filed: Mar. 30, 1982

Related U.S. Application Data

[63] Continuation of Ser. No. 100,545, Dec. 5, 1979, Pat. No. 4,342,275, which is a continuation of Ser. No. 860,605, Dec. 14, 1977, abandoned.

[30] Foreign Application Priority Data

Dec. 15, 1976 [DE] Fed. Rep. of Germany ..... 2656738
Nov. 11, 1977 [DE] Fed. Rep. of Germany ..... 2750437

[51] Int. Cl.[3] ..... B63H 25/06

[52] U.S. Cl. ..... 114/162; 114/150; 244/87

[58] Field of Search ..... 114/144 R, 144 E, 150, 114/162, 163, 164, 165, 167; 244/83 A, 78, 87, 226, 90 R

[56] References Cited

U.S. PATENT DOCUMENTS

| | | | |
|---|---|---|---|
| 1,515,024 | 11/1924 | Flettner | 114/163 |
| 2,246,203 | 6/1941 | Florez | 244/87 |
| 2,445,940 | 7/1948 | Copeland | 114/144 R |
| 3,415,468 | 12/1968 | Labombarde | 244/87 |

*Primary Examiner*—Trygve M. Blix
*Assistant Examiner*—Jesus D. Sotelo
*Attorney, Agent, or Firm*—Toren, McGeady and Stanger

[57] ABSTRACT

A rudder assembly for marine craft wherein the main rudder carries one or more fins pivotable as well as lockable in relation to it, wherein the actuating and control devices for the fin are integrated with the rudder assembly.

7 Claims, 4 Drawing Figures

FIN RUDDER FOR SHIPS

Figure 1:
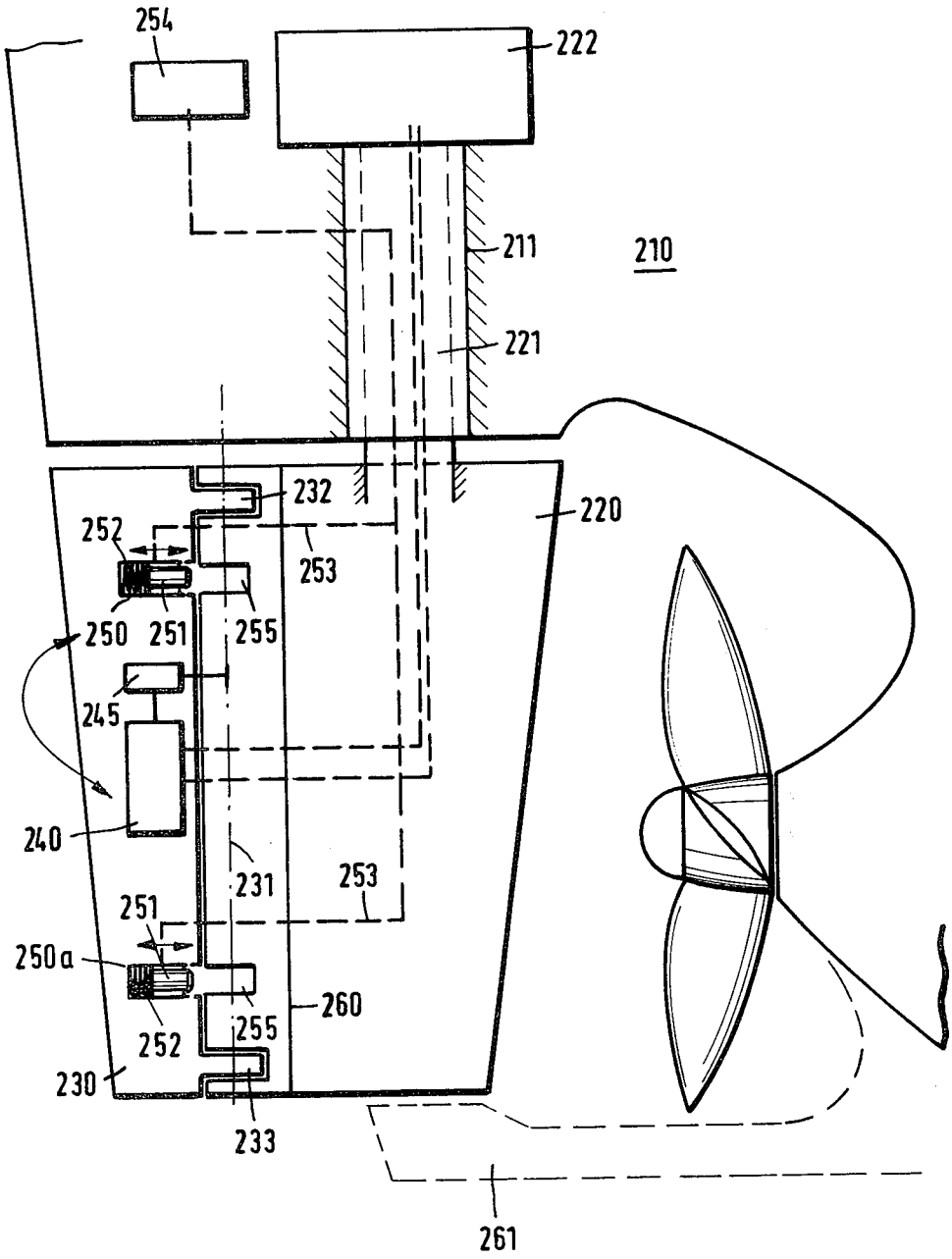

This is a continuation of application Ser. No. 100,545, filed Dec. 5, 1979, now U.S. Pat. No. 4,342,275, issued Aug. 3, 1982, which, in turn, is a continuation of application Ser. No. 860,605, filed Dec. 14, 1977, now abandoned.

The present invention relates to a rudder for marine craft, the rudder including a fin pivotable by an actuating device, and a fin control system.

A rudder in the form of a pivotable plate or a displacement body is disposed at the stern of a ship and upon action, i.e. when pivoted by a controlled angle of deflection, develops a hydro-dynamic transverse force which acts on the rudder and correspondingly on the stern of the ship. This force produces the turning torque required to steer the ship. This hydro-dynamic transverse force produces a torque on the rudder with respect to the rudder stock which is to be supplied by the steering gear.

Also known is a prior art rudder where a positively controlled fin is deflected in opposition to the main rudder deflection without the aid of powered steering gear in order to establish torque equilibrium with respect to the rudder stock.

Further, as a multiple displacement rudder, an articulated rudder has become known. As in the case of all known multiple displacement rudders, excepting the aforementioned prior art rudder, the drive of their serveral components is derived from externally installed mechanical actuators, such as a fixedly mounted, turnable sliding tube with a slidable lug which is firmly connected with the tail fin. The high efficiency of such rudders is attributed to the severe flow deflection at the pressure side of the rudder, whereas the suction side can be influenced by driven rotors or jet valves. As is well known, the efficiency of conventional rudders or rudders with influence on the pressure side decreases with diminishing ship's speed by the square of the speed while steerability (depending on type of ship) is pracitically lost around 6 to 3 knots.

With increasing ship's size and speed a considerable increase in the size of the powered steering gear is notable and in modern powered steering gear, the developed torque may reach significantly higher relative magnitudes. In the case of multiple high buoyancy rudders of former design the rudder torque is still larger than with a single displacement rudder of equal lateral plane.

Multiple high-performance rudders are not commutable however as, for instance, the rotor rudder or the jet valve rudder. They provide their hydrodynamic improvements or capabilities not only when these are needed but also at normal cruising speeds. The need to use a high-performance rudder is rare compared to the total time of application; in the case of containerships it amounts of about 6 hours during a voyage, or mostly even less.

The features of a high-performance rudder which cannot be commuted necessitate (depending on the regulations of the classification authorities) correspondingly heavier associated components, such as rudder stock, pintles, powered steering gear, neighboring structural elements and the like. In the case of flap rudder proposed by in the prior art great loads are imposed on the fin actuation in addition to the disadvantages mentioned above. Welding stresses and deformation of components cause difficulties during onboard assembly in respect to bearing fits. In case of damage it is not possible to convert such a flap rudder to a single member rudder on account of its high overbalance; it would automatically turn into a hard-over position.

A high-performance rudder contributes nothing to the improvement of the course stability of a ship (which plays a paramount part in the economic running of a ship), since these features are defined for the behavior of a ship with unoperated rudder.

The object of the present invention is the creation of a rudder with a fin for marine craft where it is possible to arrest the independent movement of the fin which eliminates the need for the heavy construction of a high-performance rudder including its associated elements, which can always be converted to a single-member rudder, and where it is possible to retrofit a normal rudder to a high performance rudder without great technical effort and high cost, as well as an installation to control the fin of fin rudders with a limitation of rudder torque and transverse force by an automatic hydro-pneumatic reduction of fin deflection.

In order to attain this object a rudder assembly is proposed of the type described above which according to the invention is so constructed that the actuation and control means for pivoting the rudder fin in relation to the main rudder are integrated with the rudder assembly.

Also, the rudder fin may consist of several bladed members which are individually pivotable independent of each other.

Further, the invention provides for a rudder assembly in which at least one means per fin section is provided within the rudder assembly to interlock the fin, or individual fin members of a multi-member fin, with the main rudder in alignment with it.

The system for the pivoting of the fin is designed in such a manner that the fin control system contains an hydraulically operable fin actuating arrangement which is powered from the steering gear that provides the fin torque. In addition, a hydro-pneumatic fin retard arrangement is provided for the elimination of the fixed ratio of the deflection angles of main rudder and of fin in dependence of fin torque which contains return tanks for compression of the pressure gas corresponding to maximum fin torque and also pressure bias tanks.

Furthermore, the invention provides for an embodiment in which the system is designed in such a way that the fin device consists of two hydraulically operated jacks with pistons slidable in the cylinder housings the piston rods of which are attached to the fin for its two-way pivoting, that each interior of the cylinder housing is connected over an hydraulic line with the interior of the housing of one of two further jacks operable by the powered steering gear with pistons slidable in the cylindrical housings, the piston rods of which are connected over a cantilever with the rudder stock which is linked to the powered steering gear, that the two hydraulic lines which are connected with the jacks are connected over a line with an equalizer and refill valve, and that, as fin retard arrangement, each of the two hydraulic lines is connected respectively with a line which connects one pressuregas-operated return tank with one pressuregas-operated bias pressure tank where the two return tanks and the two bias pressure tanks are connected over pressuregas lines of which is equipped with two valves.

The integration of the actuation devices with the main rudder or the rudder fin provides the advantage that a normal rudder can always be converted to a high-performance rudder without the rudder having to be rebuilt with heavier components, that increased drag by external parts is avoided, and that susceptability to corrosion is excluded. Actuating devices for the rudder fin on the ship itself are not required any more and need not be installed in its since the fin to be attached to the main rudder is already provided with the actuating devices which are connected to the fin pivot axis directly or by suitable transmissions.

The provision of interlocking or clamping devices for the rudder fin has the advantage that fin rudders can at any desired time be converted to singlemember rudders. The hydro-dynamic features can therefore be adapted to any momentary speed profile whereby especially heavy dimensioning of the rudder attachments becomes avoidable. In the event of failure of the interlocking devices for the rudder fin, this is automatically set into the locked position (for instance, by spring pressure), so that a ship under way can not become incapable of being maneuvered. Fitting difficulties are avoided which are known to occur often during onboard assembly and are occasioned by welding stresses or deformations of attachment parts from other causes. This also makes a retrofit of a conventional single-member to a fin rudder time-saving and less expensive.

The line with the equalizing and refill valve which connects the two hydraulic lines is disposed between the connecting lines for the jacks connected to the fin and the connecting lines for the bias pressure and return tanks.

A bias pressure gas line leads into the line which connects the bias tanks with each other and a return pressure gas line into the line which connects the return tanks with each other. An oil replacement line leads into the connecting line with the equalizing valve.

With the invention, an installation is created for a limitation of rudder torque and transverse force by an automatic hydro-pneumatic reduction of fin deflection. Based on this design of the installation, it is possible to effect a shortcircuiting of both lines by means of the equalizing valve upon passage of the rudder through its zero-position for the purpose of correction of the fin's zero-position. For this, the equalizing valve is held open over a range of deflection angles of the main rudder of about 2°. In case of an irregular fin deflection caused by leakage losses, the fin torque occuring in the zero-position of the main rudder effects a resetting of the fin into its zero-position. Leakage oil seeping from the system is replaced by an oil pump which is connected with the equalizing valve. This oil pump feeds with a pressure slightly above the bias pressure as long as the equalizer valve is open.

This ensures that the bias pressure tank is always in its hind stop position and the system remains operative. The gas pressure of bias pressure tank and return tank is monitored over the bias pressure gas line, or a pressue monitor respectively, and, if necessary, is boosted a zero-position of the rudder. With sufficiently tight tanks, such as tanks with spherical bellows, the pressure monitor can be dispensed with. The boosting in case of pressure loss can be effected during checks.

Other advantageous embodiments of the invention become evident from the further claims.

Figure 2:
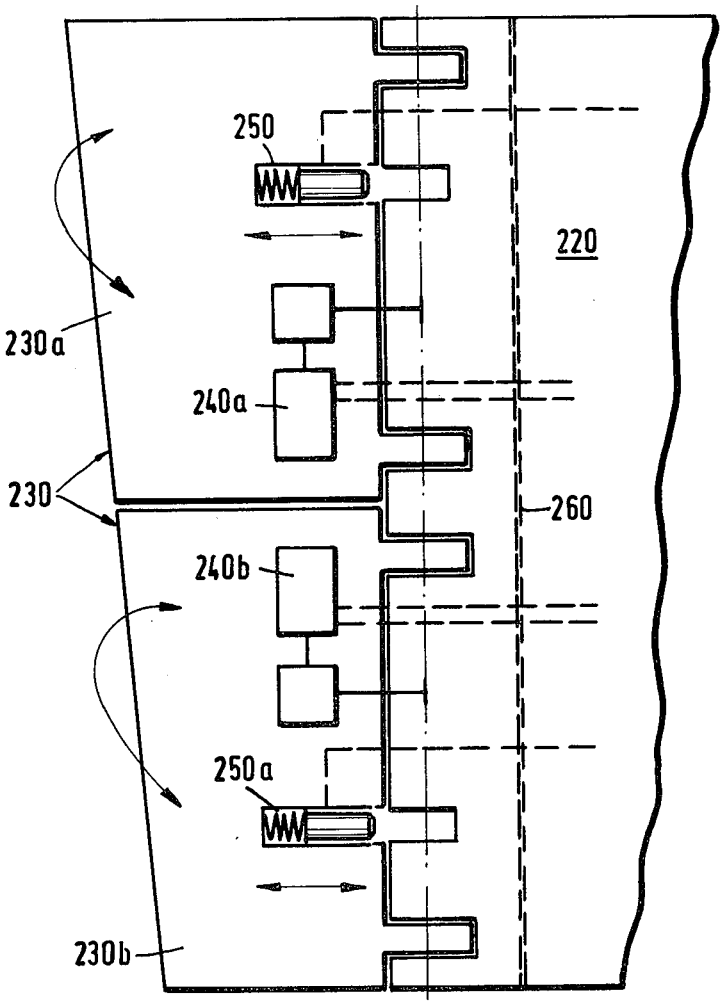
Figure 3:
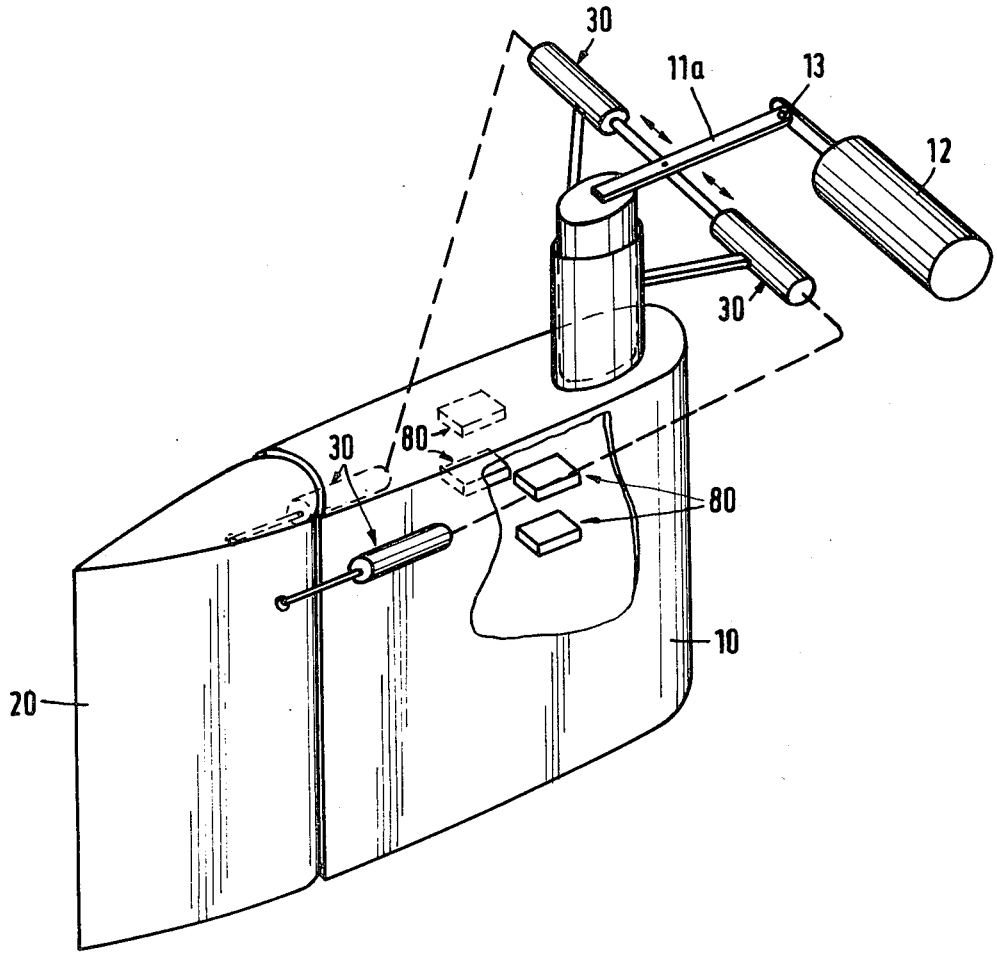
Figure 4:
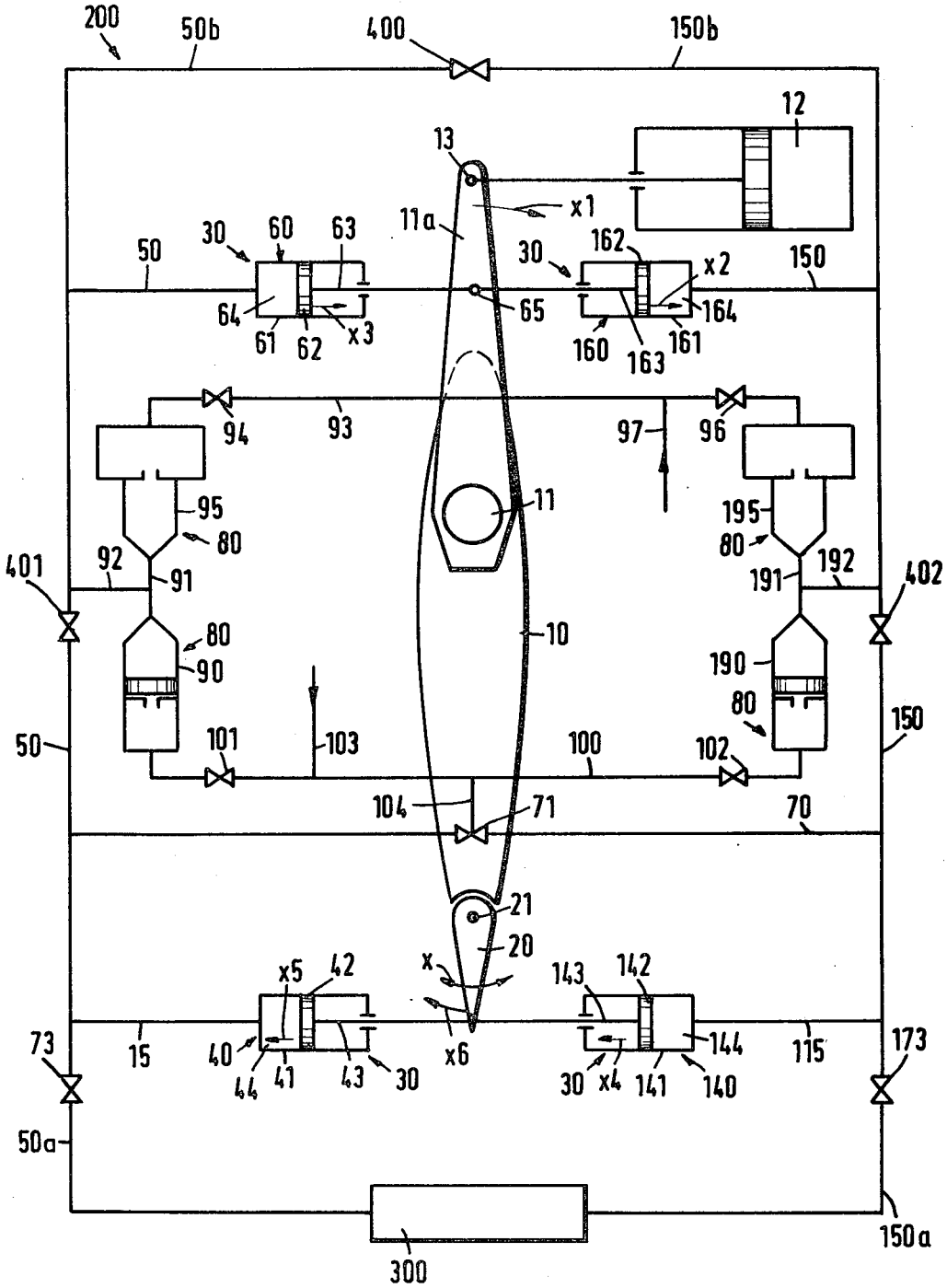

Examples of embodiments of the invention are illustrated in the drawing. The drawing shows in:

FIG. 1 a rudder assembly in longitudinal cross-section;

FIG. 2 a further embodiment of the invention with a rudder assembly comprising two fin sections in longitudinal cross-section;

FIG. 3 a fin control system disposed on a fin rudder assembly for limiting rudder torque and transverse force by an automatic retard of the fin in perspective representation;

FIG. 4 the installation in a schematic representation.

In the embodiment of a rudder assembly according to the invention shown in FIG. 1 210 denotes the body of a ship, 211 a rudder port and 220 a main rudder which is connected to a powered steering gear indicated at 222 by means of a rudder stock 221.

The main rudder 220 carries a fin 230 which is pivotably connected to the main rudder 220 at 232 and 233 and is adjustable about the pivotal axis indicated at 231.

An actuating device 240 is provided within the fin 230 for the adjustment of the fin. This actuating device 240 consists of at least one hydraulically or electrically driven motor or of an hydraulic cylinder with or withoutt a following gear train. It can however be built in the form of a blade-type device. The actuating device 240 is connected to a control system located within the ship but not shown in the drawing.

Further, the rudder fin 230 carries an interlocking device 250 or **250*a* to lock the rudder fin in such manner that the fin assumes a position in alignment with the main rudder 220**. By means of this interlocking feature the formation of a rigid rudder is possible. The locking device can also be located externally.

Each of the fin locks 250 or **250*a* consists of preferably hydraulically operated locking bolts, catches, a strap or chain brake or the like 251. The hydraulic cylinder provided therefor is connected by a pipeline 253 with a suitably designed drive and control means 254. The locking bolt 251 of the locking device 250 or 250*a* can enter into a suitably shaped recess 255 in the main rudder 220 when the rudder fin is to be interlocked with the main rudder. In case that the hydraulics for the locking bolts 251 should fail, an automatic interlocking of fin 230 and main rudder 220 is possible. A bias for the locking bolt 251 is provided for this by a compression spring 252 and in the event of failure of the hydraulics normally actuating the bolt the spring pushes the locking bolt 251 into the locked position. The whole arrangement and designof the locking device 250 or 250*a* is such that the locking bolt 251 in its retracted position bears on the compression spring 252 and compresses it. The locking bolt 251 is hydraulically held in the position as long as the rudder fin is to be freely pivotable. Upon cut-off of the hydraulic pressure the locking bolts 251 is pushed into its locked position by means of the expanding compression spring 252. The movement of the locking bolt 251** in either direction can however be solely effected by an hydraulic drive. Also, other technical solutions are possible. The number of locking devices to be used depends on the height of the rudder assembly. But it is assumed that at least one locking device will be in use.

The actuator 240 for the rudder fin 230 need not be located within the fin itself. It is quite possible to locate the actuator 240 within the main rudder 220. Likewise, the locking device 250 or **250*a* may be located within the main rudder 220, so that in this case the locking bolts of the locking devices 250 or 250*a* enter into the rudder fin 230. Also, it is possible to arrange the actuator 240 in such a manner that direct power transmission onto the rudder stack 221** occurs.

As shown in FIG. 2 in that portion of the rudder assembly which FIG. 1 is delimited by the dividing line 260, the rudder fin 230 can also consist of two sections 230 a and 230*b* the separation of which lies at about half of the height of the main rudder. Each fin section 230*a* or 230*b* is then effectively connected with at least one actuator 240*a* or 240*b* in adaptation of the rudder assembly to the twist flow from the propeller. Also, single operation of the rudder fin sections 230*a*, 230*b* is just as possible by these means as an opposite deflection of the fins to serve as stopping assistance. In addition, each fin section 230*a*,230*b* can be interlocked with the main rudder 220 just as the entire fin 230. The interlocking devices are indicated in FIG. 2 as 250 and 250*a*.

The circumstance that the actuator 240 as well as the interlocking devices 250 and 250*a* are accommodated within the rudder fin offers possibility of converting any rudder to a high-performance rudder with fin without necessiting complicated technical reconstruction. Should the fins 230 and the main rudder 220 have at first formed a single-unit rudder to be retrofitted, a cut would be made along the line 260. Since the alteration to the rudder is effected at its hind portion, this method is not restricted to the spade-type rudder as shown in the drawing, but can be applied with equal success to rudders of all kinds, such as stemhook rudders as semi-suspension rudders.

The rudder with locked fin is usable as a normal rudder and with movable fin as a high-performance rudder. It can also be used solely with the fin serving as rudder should the main rudder to jammed. Fin steering can be carried out in accordance with programmed or freely selected conditions whereby all fin sections can be controlled in common or independently of each other if the rudder has several fin sections.

FIGS. 3 and 4 show an installation 200 for the control of the fin. 10 denotes a main rudder to which a fin 20 is pivoted in 21. The operation of the rudder is effected by a powered steering gear indicated in 12. This is either in direct effective connection with the rudderstock 11 or, as shown in FIG. 4, through engagement at 13 with a contilever 11*a* which is connected to the rudderstock 11.

For operation of the fin 20 in one of the directions of the arrow x, i.e. its deflection, a device 30 is provided which consists of the hydraulic jacks 40, 140 which engage the fin on both sides. Since the jack 140 is constructed in correspondence with jack 40, only jack 40 will be described more closely in the following.

The jack 40 consists of a cylindrical housing with a piston 42 which is movably contained in its interior 44. The rod 43 of the piston is connected to the fin 20. The element of jack 140 which correspond to those of jack 40 are denoted as 141, 142, 143 and 144.

The hydraulic jacks 40 and 140 which are disposed at either side of fin 20 are connected by their piston rods 43, 143 with fin in such a manner that this pivots in one of the directions of the arrow x in correspondence with the position of the pistons 42, 142. The ends of the piston rods 43, 143 may engage the fin laterally or may be connected to the pivotal axis indicated at 21, for instance, by a yoke or by bendable transmission members. In the technical embodiment the two jacks 40, 140 are disposed on or within the main rudder.

The two jacks 40, 140 are connected by means of hydraulic pipe lines 50, 150 with two further jacks 60, 160 which, in turn, are operable by the powered steering gear 12. The hydraulic lines lead into the pressure compartments, i.e. the interior, 44, 144 of the two jack housings 41, 141, so that the hydraluic fluid entering the interior compartments under pressure causes a movement of the pistons 42, 142 and thus the position of fin 20 is controlled.

The jack 160 is constructed in correspondence with jack 60. Therefore only jack 60 will be described more closely in the following.

This jack 60 consists of a cylindrical housing 61 with a piston 62 which is movably contained in it. The rod 63 of the piston is connected to the power transmission from the steering gear. The elements of jack 160 which correspond to those of jack 60 are denoted as 161, 162, 163 and 164.

In the embodiment of the invention represented in the drawing the free ends of the piston rods 63, 163 of the two jacks 60, 160 are pivotably attached at 65 to the cantilever arm 11*a* so that the piston 162 of jack 160 is moved in the direction of the arrow x2 and the piston 62 of jack 60 in the direction of arrow x3 upon a pivoting movement of the rudderstock 11 in the direction of the arrow x1. This results in a movement of pistons 42, 142 of the two jacks 40, 140 in the direction of the arrows x4 and x5 respectively so that fin 20 is pivoted in the direction of the arrow x6.

The installation in accordance with the invention comprises, in addition to the fin actuating mechanism 30, a fin retard arrangement 80 which is operated pneumatically and which consists of two bias pressure tanks 90, 190 and return tanks 95, 195. Pressure tank 90 is connected with the return tank 95 over a line 91 and, respectively, 190 with 195 over 191. The bias pressure tanks and the return tanks are constructed in a conventional manner. The line 91 which connects the bias pressure tank 90 and the return tank 95 leads over the connecting line 92 into the hydraulic line 50 which connects the jacks 40 and 60 with each other, whereas line 191 which connects the bias tank 190 and the return tank 195 leads over the connecting line 192 into the hydraulic line 150 which connects the jacks 140 and 160 with each other.

The two bias pressure tanks 90 and 190 are connected with each other by a pressure gas line 100 into which are inserted the two valves 101 and 102. A bias pressure gas line 103 leads into the section of the line 100 between the two valves 101 and 102.

Also, the two return tanks 95 and 195 are connected with each other over a pressure gas line 93 into which are inserted the two valves 94 and 96. A return pressure gas line 97 is provided in the section of connecting line 93 between the two valves 94 and 96.

In the section of the two hydraulic lines 50 and 150 between the lines 92, 91; 192, 191 which connect the bias pressure tanks 90, 190 with the return tanks 95, 195 and the two jacks, 40, 140 a line 70 is provided which connects the two hydraulic lines 50 and 150. It is equipped with an equalizer and refill valve 71 which is a three-way valve. At the zero-position of the main rudder 10 it holds open not only the equalizer line 70 but also simultaneously opens into the return line 104 which connects valve 71 with the connecting line 100 between the two bias pressure tanks 90 and 190.

Furthermore, the hydraulic lines 50, 150 can be connected with a device a indicated as 300 over line sections 50*a* and 150*a* which supplies a feed when the fin 20 is to be controlled from the bridge. These line sections 50*a* and 150*a* contain shut-off valves 73 and 173.

Also, between the two hydraulic lines 50 and 150, the installation can be provided with a connecting line 50*b*, 150*b* which carries the shut-off valve 400. If now the two valves 401 and 402 which are placed into the lines 50 and 150 are closed, the two hydraulic jacks 30 can be short-circuited over the line 50*b*, 150*b* and the valve 400 which must be opened in such case. The fin 20 is now rigidly locked onto the main rudder 10. The automatic correction for the zero-position of the fin over the hydraulic line 70 and valve 71 as well as the feed over the supply line 104 to compensate for leakage losses is retained.

Into each of the two hydraulic lines 50 and 150*a* valve 401, 402 is inserted between the connecting lines 92 or 192 for the lines 91, 191 wchich connect the bias pressure tanks 90, 190 with the return tanks 95, 195. These valves 401, 402 make it possible to separate the main rudder system and the fin system. Thus, the automatic zero correction as well as the replacement of leaked oil is retained even when the fin is locked or when the fin is operated separately independent of the main rudder. So that in the case of separate fin operation, i.e. when valves 401 and 402 closed, the main rudder is not jammed or has to overcome the bias pressure tanks, it must be possible to short-circuit the jacks 30 over the line 50*b*, 150*b* by opening valve 400 which is inserted into this line.

Should the fin be required to steer the ship at zero position of the main rudder, the additional valves 401 and 402 in the hydraulic lines are closed and thus the hydraulic system is cut off. In such case the fin can be operated like a normal rudder by means of the feeder valves 73 and 173 provided in the hydraulic lines and by a separate pump system. For this purpose a rudder position indicator must be fitted to the fin. The independent fin steering requires about 5% of the power of the steering gear with equal speed of deflection.

The installation according to the invention operates as follows: the fin actuating system 30 which consists of the jacks 40, 140; 60, 160 is driven by the powered steering gear 12. Thus, the steering gear must provide also the torque to pivot the fin. A fixed ratio of the angular positions of main rudder and fin in relation to the main rudder position is attained by the hydraulic coupling.

The hydro-pneumatic fin retard system 80 cares for the elimination of the fixed ratio of the angles of main rudder and fin in dependence on fin torque. The system consists of the return tanks 95, 195 and the bias pressure tanks 90, 190. The individual return tanks 95 and 195 are charge to a degree by pressured gas as corresponds to the desired maximum fin torque. By suitable selection of the compressible compared to the non-compressible tank volume discretionary characteristics of the tank can be produced. Spherical or cylindrical tanks can be used for storage. The compressible tank volume amounts to about half of the fin operating volume.

Upon exceeding the set fin torque, oil is conveyed into the tank until pressure and fin torque are equal. The bias pressure tank supplies the replacement volume. The bias pressure tank is exposed to such a pressure that the replacement is assured when fin deflection is lessened. The volume of this tank corresponds to that of the return tank.

What is claimed is:

1. A rudder assembly for marine craft comprising: a main rudder member pivotally coupled to said marine craft for deflection relative thereto; a fin member pivotally coupled to said main rudder member for deflection relative thereto; and an actuating and control system comprising first control means operative to effect deflection of said main rudder member relative to said marine craft and second control means operative to effect deflection of said fin member relative to said main rudder member; said first control means being capable of effecting deflection of said main rudder member relative to said marine craft independently of said second control means; said second control means being effective to effect deflection of said fin member relative to said main rudder member independently of said first control means, said first and second control means being operative, respectively, to effect deflection of said main rudder member and said fin member simultaneously to enable simultaneous and independent control of said main rudder member and said fin member during normal operation of said rudder assembly.

2. A rudder assembly according to claim 1 wherein said actuating and control system is arranged to have at least a substantial portion of the operating components thereof physically located within the structure of at least one of said main rudder member and said fin member.

3. A rudder assembly according to claim 1 wherein said fin member is formed with a plurality of parts each pivotable relative to said main rudder member separately of the other.

4. A rudder assembly according to claim 1 further comprising interlocking means releasably locking said fin member in fixed engagement with said main rudder member.

5. A rudder assembly according to claim 3 further comprising interlocking means for enabling each of said parts of said fin member to be independently releasably locked in fixed engagement relative to said main rudder member.

6. A rudder assembly according to claim 4 or 5 wherein said interlocking means comprise bolt members adapted to be selectively actuated in releasable locking engagement between said fin member and said main rudder member.

7. A rudder assembly according to claim 6 wherein said interlocking means include spring means applying a spring force urging said bolt members into locking engagement between said fin member and said main rudder member.

* * * * *